US011396640B2

(12) United States Patent
Petkov et al.

(10) Patent No.: US 11,396,640 B2
(45) Date of Patent: Jul. 26, 2022

(54) SURFACTANT SYSTEM

(71) Applicant: KL-KEPONG OLEOMAS SDN BHD, Selangor (MY)

(72) Inventors: Jordan Todorov Petkov, Stockport (GB); Hui Xu, Selangor (MY); Yee Seng Lim, Selangor (MY); Yee Wei Ung, Selangor (MY)

(73) Assignee: KL-KEPONG OLEOMAS SDN BHD, Petaling Jaya (MY)

( * ) Notice: Subject to any disclaimer, the term of this patent is extended or adjusted under 35 U.S.C. 154(b) by 204 days.

(21) Appl. No.: 16/631,616

(22) PCT Filed: Jul. 16, 2018

(86) PCT No.: PCT/MY2018/050050
§ 371 (c)(1),
(2) Date: Jan. 16, 2020

(87) PCT Pub. No.: WO2019/017764
PCT Pub. Date: Jan. 24, 2019

(65) Prior Publication Data

US 2020/0165543 A1 May 28, 2020

(30) Foreign Application Priority Data

Jul. 19, 2017 (MY) ..... PI 2017702647

(51) Int. Cl.
*C11D 1/83* (2006.01)
*C11D 1/29* (2006.01)
(Continued)

(52) U.S. Cl.
CPC ..... *C11D 1/29* (2013.01); *C11D 1/83* (2013.01); *C11D 3/201* (2013.01); *C11D 3/2017* (2013.01); *C11D 3/43* (2013.01); *C11D 17/003* (2013.01)

(58) Field of Classification Search
CPC ..... C11D 1/29; C11D 1/83
See application file for complete search history.

(56) References Cited

U.S. PATENT DOCUMENTS 4,675,128 A * 6/1987 Linde ..... C11D 1/28 510/537
5,945,394 A 8/1999 Sajic et al.
(Continued)

FOREIGN PATENT DOCUMENTS

| | | |
|---|---|---|
| WO | 2010/027608 | 3/2010 |
| WO | 2012/061108 | 5/2012 |
| WO | 2016/160407 | 10/2016 |

OTHER PUBLICATIONS

International Search Report for PCT/MY2018/050050, dated Sep. 12, 2018, 10 pages.
(Continued)

*Primary Examiner* — Necholus Ogden, Jr.
(74) *Attorney, Agent, or Firm* — Nixon & Vanderhye P.C.

(57) ABSTRACT

The invention relates to a surfactant composition comprising a primary surfactant of sulfonated methyl ester (SME) of a fatty acid having a chain length of 16 to 18 carbon atoms (C16-C18); a secondary surfactant having a carbon chain length shorter than that of the primary surfactant; a non-ionic co-surfactant; a hydrotrope; and a solvent. The secondary surfactant can be a SME of a fatty acid having a chain length of 12 to 14 carbon atoms (C12-C14) or sodium lauryl ether sulfate (SLES). The invention also relates to use of said surfactant composition as a surfactant system in a detergent.

18 Claims, 2 Drawing Sheets

(51) Int. Cl.

| | |
|---|---|
| ***C11D 3/20*** | (2006.01) |
| ***C11D 3/43*** | (2006.01) |
| ***C11D 17/00*** | (2006.01) |

(56) References Cited

U.S. PATENT DOCUMENTS

| | | | | |
|---|---|---|---|---|
| 6,362,147 | B1 * | 3/2002 | Castro | C11D 1/65<br>510/228 |
| 9,719,049 | B2 * | 8/2017 | Morigaki | C11D 1/28 |
| 2016/0244697 | A1 * | 8/2016 | Morigaki | C11D 1/12 |

OTHER PUBLICATIONS

Written Opinion of the ISA for PCT/MY2018/050050, dated Sep. 12, 2018, 4 pages.
International Preliminary Report on Patentability for PCT/MY2018/050050, dated Jun. 11, 2019, 15 pages.

* cited by examiner

SURFACTANT SYSTEM

This application is the U.S. national phase of International Application No. PCT/MY2018/050050 filed 16 Jul. 2018, which designated the U.S. and claims priority to MY Patent Application No. PI 2017702647 filed 19 Jul. 2017, the entire contents of each of which are hereby incorporated by reference.

FIELD OF INVENTION

The invention relates to a composition for use as a surfactant system. In more particular, the invention relates to a composition of surfactant mixture containing sulfonated methyl esters. The composition can be produced in the form of paste and is useful as a surfactant system which can be applied in or formulated into a detergent.

BACKGROUND OF THE INVENTION

The sulfonated methyl ester (SME)-based surfactants have been extensively studied and formulated since 1950. SME is also known as α-sulfo fatty acid methyl ester or methyl ester sulfonates (MES). It represents a class of anionic surfactants, which is widely used in industrial applications, including powder and liquid laundry detergents, as well as dish washing detergents.

SMEs have been considered as green alternative surfactants, as they are derived from natural, renewable resources, such as palm oil. Owing to such renewable properties, SMEs have gradually become a more attractive option to be included in certain detergent formulas as surfactants. To date, long carbon chain SMEs (e.g. C16-C18) are generally available in the markets, in the form of flakes or powder. However, due to the softening point of C16-C18 SME ranging between 45° C. to 55° C. (which varies subject to purity and mixture of the composition), long term storage of such flakes or powder form or rapid temperature changes due to transportation may lead to serious caking issues, where a huge or hard solid lump will form, subsequently affecting its practicality in usage.

Apart from the caking issues, SMEs in the form of flakes or powder would require a heating process at high temperature so that the flakes or powder can be melted before being further used in a surfactant system for detergents. High temperature heating for pro-longed periods could lead to generation of disodium salt (di-salt) as a result of SME hydrolysis. These di-salt molecules would have different properties from their equivalent mono-salt SME molecules, which bring in the stability issues of the end product and often negatively impact the cleaning performance.

On the other hand, short carbon chain SMEs (e.g. C12-C14), which are the low surface active SMEs are also produced and commercialized in the market. This form of SMEs could be readily used in liquid type end products, such as liquid detergents. However, the detergency of these shorter carbon chain length surfactants is usually more inferior compared to those of longer carbon chain length surfactants (e.g. C16-C18), hence the use of short chain SMEs as surfactants for liquid detergents is not as desired.

Therefore, there is a need in the industry to produce SMEs in the form of liquid or paste. There are a number of technologies existing in the art relating to SME-based surfactant systems or compositions as well as methods for making the same. These technologies involve the use of SME in various types and combinations. For example, Chinese patent no. CN102321505 discloses a compound surfactant containing approximately 20% to 80% SME of 16-18 carbon atoms and a method for preparing thereof. This compound surfactant is in the form of liquid or paste. However, this formulation uses a combination of an anionic surfactant with an amphoteric surfactant which is difficult to handle, as amphoteric surfactant would turn into cationic at lower pH. Besides, the formulation also requires a freezing point lowering agent such as inorganic or organic salts, which limits the formulation of a surfactant system. Salts generally work as thickening agent and could increase the viscosity of the surfactant solution under certain conditions. There is no disclosure provided in this document on the performance of this C16-C18 SME-based paste surfactant.

There are also other existing technologies available in the art which use SMEs of other carbon chains in producing surfactant or formulating detergent. However, there is no teaching provided in the prior art on any specific or unique blend or mixture of SMEs which can give rise of a highly active surfactant system with the desired flowability as well as is being able to provide a high cleaning performance. Therefore, an improved composition of SME-based surfactant is desirable.

SUMMARY OF INVENTION

One of the objects of the invention is to provide a highly active SME-based surfactant composition in the form of liquid, semi-solid or paste, which remains flowable at a predetermined range of temperature and is capable of providing a high cleaning performance.

The invention also aims to provide a liquid, semi-solid or paste form of SME surfactant which does not form a cake, thus are beneficial for transportation and long term storage. By providing the SME surfactant in the form of liquid, semi-solid or paste, the heating process at high temperature for melting solid SMEs can be eliminated, thus avoiding the formation of side products such as di-salt that affects the cleaning performance.

At least one of the proceeding objects is met, in whole or in part, by the invention, in which one of the embodiments of the invention describes a surfactant composition comprising a primary surfactant of SME of a fatty acid having a chain length of 16 to 18 carbon atoms (C16-C18); a secondary surfactant having a carbon chain length shorter than that of the primary surfactant; a non-ionic co-surfactant; a hydrotrope; and a solvent.

According to one embodiment of the invention, the secondary surfactant is a SME of a fatty acid having a chain length of 12 to 14 carbon atoms (C12-C14), or sodium lauryl ether sulfate (SLES).

In accordance with another embodiment of the invention, the composition is in the form of liquid, semi-solid or paste. In certain embodiments, the composition has a viscosity of 11.5 to 10.0 Pa·s under shear rate 10 $s^{-1}$ at a temperature range of 35° C. to 45° C.

In accordance with a preferred embodiment of the invention, the primary surfactant is present in an amount of 35% to 75% by weight of the composition. In certain embodiments, the primary surfactant is a SME compound containing 55% to 95% of C16-SME and 5% to 45% of C18-SME by weight of the primary surfactant.

According to another preferred embodiment of the invention, the secondary surfactant is present in an amount of 8.5% to 35% by weight of the composition. In certain embodiments, the secondary surfactant is a SME compound containing 55% to 95% of C12-SME and 5% to 45% of C14-SME by weight of the secondary surfactant. Alternatively, this C12-C14 SME mixture can be replaced by SLES.

Still another embodiment of the invention discloses that the non-ionic co-surfactant is present in an amount of 5% to 10% by weight of the composition. Preferably, the non-ionic co-surfactant is cocamide monoethanolamide (CMEA), cocamide diethanolamide (CDEA), or a combination thereof.

A further embodiment of the invention discloses that the hydrotrope is present in an amount of 5% to 10% by weight of the composition. In certain embodiments, the hydrotrope is a primary, secondary or tertiary alcohol having a linear or branched alkyl chain of 3 to 8 carbon atoms. Preferably, the hydrotrope is isopropyl alcohol (IPA) or ethanol.

It is also disclosed in another further embodiment of the invention that the solvent is water. Preferably, the solvent is present in an amount of 5% to 30% by weight of the composition.

Yet another further embodiment of the invention discloses use of a surfactant composition comprising a primary surfactant of SME of a fatty acid having a chain length of 16 to 18 carbon atoms (C16-C18); a secondary surfactant having a chain length shorter than that of the primary surfactant; a non-ionic co-surfactant; a hydrotrope; and a solvent, as a surfactant system in a detergent. In certain embodiments, the secondary surfactant is a SME of a fatty acid having a chain length of 12 to 14 carbon atoms (C12-C14).

The SME-based surfactant composition is in the form of liquid, semi-solid or paste, hence it would be more preferable in the industry for its stability and easier incorporation in the detergent formulations. As the heating process at high temperature is not required, it may also result in energy saving and lower processing costs. The detergents formulated using the SME-based surfactant composition of the invention also provides additional benefits such as biodegradable and low toxicity.

The present preferred embodiments of the invention consist of novel features and a combination of parts hereinafter fully described or illustrated in the accompanying drawings and particularly pointed out in the appended claims; it being understood that various changes in the details may be effected by those skilled in the arts but without departing from the scope of the invention or sacrificing any of the advantages of the invention.

BRIEF DESCRIPTION OF THE DRAWINGS

For the purposes of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

Figure 1:
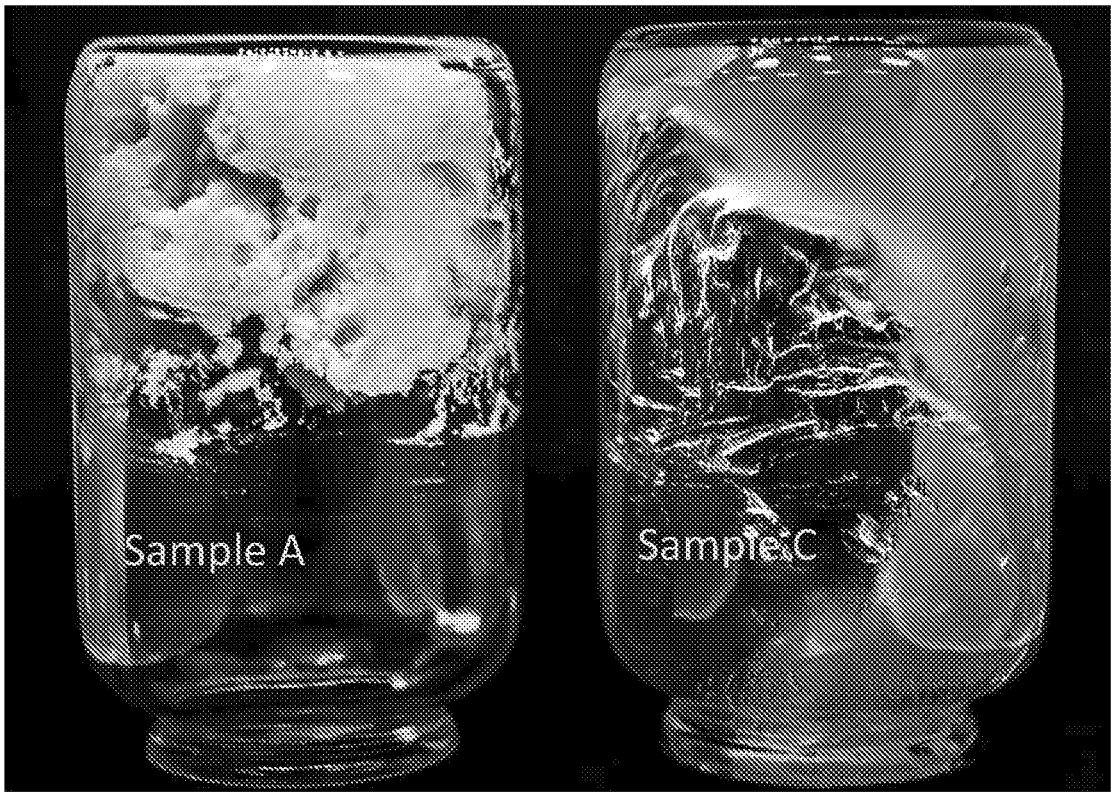
FIG. 1 is a photographic representation showing the flowability state of a sample of the surfactant composition as described in one of the embodiments of the invention (Sample C), in comparison to another comparison test sample from an existing technology (Sample A), in which Sample C is shown to remain flowable after 12 months from the date of preparation, while Sample A is shown to be non-flowable after 10 days from the date of preparation.

Hereinafter, the invention shall be described according to the preferred embodiments of the invention and by referring to the accompanying description and drawings. However, it is to be understood that limiting the description to the preferred embodiments of the invention and to the drawings is merely to facilitate discussion of the invention and it is envisioned that those skilled in the art may devise various modifications without departing from the scope of the appended claim.

The invention discloses a surfactant composition comprising a mixture of different groups of surfactants, including anionic surfactants and non-ionic surfactants. In more particular, the surfactant composition comprises a primary surfactant of SME of a fatty acid having a chain length of 16 to 18 carbon atoms (C16-C18); a secondary surfactant having a carbon chain length shorter than that of the primary surfactant; a non-ionic co-surfactant; a hydrotrope; and a solvent. This surfactant composition is also known as a surfactant system.

By the term "surfactant" or "surfactant system", it refers to a compound or compounds that are capable of lowering the surface tension or interfacial tension between a liquid and a gas or between two liquids or between a liquid and a solid. Therefore, surfactant is useful as wetting agents, emulsifiers, or detergents.

As set forth in the preceding description, the primary surfactant used in the surfactant composition of the invention is SME of a fatty acid having a chain length of 16 to 18 carbon atoms (C16-C18 SME). The molecular structures of C16 SME and C18 SME used in the invention are respectively shown in the Formula (I) and Formula (II) below:

(I)

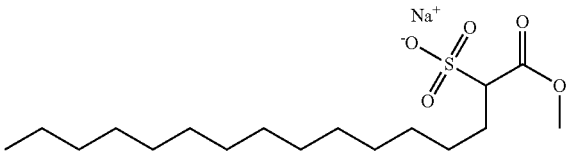

(II)

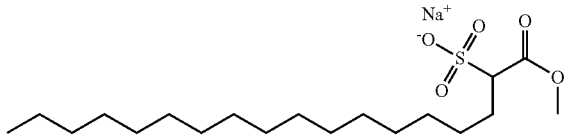

Both of these SMEs were obtained from the sulfonation of methyl ester. C16 SME is obtained from the palmitic acid; while C18 SME is obtained from stearic acid. These compounds of SME can be derived from a natural source, such as plant oils (vegetable oils) or animal fats, including palm oil.

In accordance with one of the embodiments, the primary surfactant is a SME compound containing C16 SME and C18 SME (the first SME compound). It is naturally present in the form of solid. In order to solubilise this solid primary surfactant to provide a liquid, semi-solid or paste form of surfactant, a secondary surfactant having a relatively shorter carbon chain length can be included into the composition. In certain embodiments, the secondary surfactant is a SME of a fatty acid having a chain length shorter than 16 carbon atoms. For example, it can be SME of a fatty acid having a chain length of 8 to 14 carbon atoms, i.e. C8 SME, C10 SME, C12 SME, C14 SME, or the combination thereof in a specific combination ratio. Preferably, the secondary surfactant is a SME compound having a chain length of 12 to 14 carbon atoms (C12-C14) (the second SME compound).

The molecular structures of C12 and C14 SME used in the invention are respectively shown in Formula (III) and Formula (IV) below:

(III)

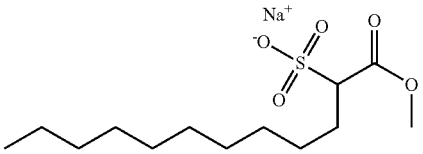

(IV)

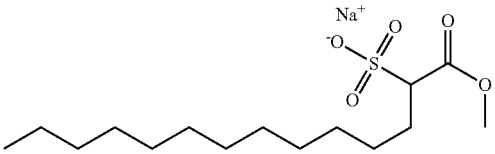

C12 SME is obtained from sulfonation of methyl laurate; while C14 SME is obtained from sulfonation of methyl myristate. These C12 and C14 SMEs can also be obtained from a natural source, such as plant oils (vegetable oils) or animal fats, including palm kernel oil and coconut oil.

In certain embodiments, the second SME compound with relatively shorter carbon chain length may be replaced by its alternative, i.e. SLES. Similar to the second SME compound (i.e. C12-C14 SME), SLES also has a shorter carbon chain length than that of the primary surfactant (i.e. C16-C18 SME), and hence capable of altering the physical properties of the surfactant composition, especially viscosity, in order to form a paste, semi-solid or liquid surfactant system.

In accordance with a preferred embodiment of the invention, the primary surfactant (i.e. the first SME compound) is present in an amount of 35% to 75% by weight of the composition. For example, it can be present in an amount of 40% to 50% by weight of the composition. In certain embodiments, the first SME compound contains C16 and C18 SME in a specific range of proportion. Preferably, it contains approximately 55% to 95% C16 SME and 5% to 45% of C18 SME by weight of the first SME compound. For example, it can contain approximately 60% to 90% of C16 SME and 10% to 40% C18 SME. As another example, it can contain approximately 65% to 85% of C16 SME and 15% to 35% C18 SME. It can also be a compound of 75% C16 SME and 25% C18 SME, or 95% C16 SME and 5% C18 SME, by weight of the first SME compound. Such proportion of C16 SME: C18 SME is specifically prepared to provide a high cleaning performance and detergency.

On the other hand, the second SME compound (as the secondary surfactant) is present in an amount of 8.5% to 35% by weight of the composition. For example, the second SME compound can be present in an amount of 10% to 20% by weight of the composition. In certain embodiments, the second SME compound contains C12 and C14 SME in a specific range of proportion. Preferably, it contains 55% to 95% C12 SME and 5% to 45% of C14 SME by weight of the second SME compound. For example, it can contain approximately 60% to 90% of C12 SME and 10% to 40% C14 SME. As another example, it can contain approximately 65% to 85% of C12 SME and 15% to 35% C14 SME. It can also be a compound of 75% C12 SME and 25% C14 SME, or 95% C12 SME and 5% C14 SME, by weight of the second SME compound. Such proportion of C12 SME: C14 SME is specifically prepared to control and enhance the flowability of the surfactant composition.

In a more specific embodiment, the surfactant composition contains a unique combination of two SME compounds, in which the first compound of SME is a blend of SME having a relatively longer carbon chain (C16 SME and C18 SME); whereas the second compound is a blend of SME having a relatively shorter carbon chain (C12 SME and C14 SME). The surfactant composition may contain predominantly the first SME compound (i.e. C16 SME and C18 SME), for example, in an amount of approximately 35% to 75% by weight of the composition. On the other hand, the second SME compound (i.e. C12 SME and C14 SME) can be present in a relatively lower amount, such as 8.5% to 35% by weight of the composition. For example, the surfactant composition may contain 40% to 50% of C16-C18 SME and 10% to 20% of C12-C14 SME, by weight of the composition. Without wishing to be bound by the theory, the presence of the first compound of SME in the surfactant composition is capable of providing a higher cleaning performance as the longer carbon chain gives the lower critical micelle concentration (CMC); while the flowability of the surfactant composition is controlled and enhanced by the presence of the second compound of SME.

In another embodiment, the secondary surfactant used in the surfactant composition can be SLES. For example, 8.5% to 35% by weight of SLES can be mixed with 35% to 75% by weight of primary surfactant (i.e. the C16-C18 SME compound) to modify the physical properties of the surfactant composition.

Amphoteric surfactant and cationic surfactant are not desired to be included in the surfactant composition of the invention. Instead, a non-ionic co-surfactant is used to improve the surfactant performance of the combination between the first and second SME compounds. According to one embodiment of the invention, the non-ionic co-surfactant can be present in an amount of 5% to 10% by weight of the composition. The non-ionic surfactant can be derived from natural source, such as a coconut fatty acid derived from coconut oil. Preferably, the non-ionic co-surfactant is CMEA, CDEA (which are also respectively known as coconut fatty acid monoethanolamide and coconut fatty acid diethanolamide), or the combination thereof. It is believed that the addition of this non-ionic co-surfactant can provide a potential synergistic effect among the various types of surfactants used in the SME-based surfactant system of the invention.

Further to the potential synergistic effect of the various types of surfactants, the surfactant composition also contains a hydrotrope. The hydrotrope employed can be a primary, secondary or tertiary alcohol having linear or branched alkyl chain of 3 to 8 carbon atoms. For example, the hydrotrope used can be IPA or ethanol. In accordance with one embodiment of the invention, the hydrotrope is present in an amount of 5% to 10% by weight of the composition. Preferably, the hydrotrope used is 5% to 10% of IPA (which is also known as isopropanol) by weight of the composition. Hydrotrope, such as IPA, is miscible in water. Therefore, the inclusion of IPA in the surfactant composition can facilitate the solubility of hydrophobic carbon chain in the aqueous solution of the composition. In other words, it helps improve the solubility of the surfactant composition.

In accordance with another further embodiment of the invention, the surfactant composition also contains a solvent, which is preferably an aqueous solvent such as water. The solvent is preferably present in an amount of 5% to 30% by weight of the composition.

As set forth in the preceding description, the surfactant composition of the invention can be provided in various forms, including liquid, semi-solid or paste. For instance, the surfactant composition can be present in the form of semi-solid under lower temperature. Preferably, the composition is prepared in the form of flowable paste. Such physical properties are achieved by having the unique combination of the two specific SME compounds of different lengths of carbon chain. Exemplary formulations of the surfactant composition are further detailed in Example 1.

Yet another further embodiment of the invention discloses the use of a surfactant composition comprising a primary surfactant of SME containing C16-SME and C18-SME; a secondary surfactant having a carbon chain length shorter than that of the primary surfactant; a non-ionic co-surfactant; a hydrotrope; and a solvent, as a surfactant system in a detergent. In certain embodiments, the surfactant composition contains a specific blend of C12-SME and C14-SME.

The surfactant composition can be produced from the various ingredients, for example, the ingredients as detailed in Example 1, via a mixing process. An exemplary production process is further detailed in Example 4, in which the specific compounds of SME, CMEA, IPA and water can be mixed in the respective predetermined weight percentages to form the SME paste surfactant composition. The different SME compounds can be first obtained from a sulphonation process of the raw materials of methyl esters. After the sulphonation process, the resulting intermediate can be subject to a neutralization process, followed by a bleaching process to produce the required SMEs.

The surfactant composition of the invention is a highly active, and having relatively higher levels of viscosity, concentration and purity. It can be produced in the form of paste, semi-solid or liquid and remains freely flowable for a relatively long period of time, for example 1 to 2 years, without turning into solid or forming cakes. In certain embodiments, the surfactant composition has a viscosity of 11.5 to 10.0 Pa·s under shear rate 10 $s^{-1}$ at a temperature range of 35° C. to 45° C. An exemplary experimental method showing the flowability of the surfactant composition is further detailed in Example 2. As demonstrated in the experimental data, the paste form SME-based surfactant composition of the invention can remain freely flowable at a temperature of approximately 35° C. for a relatively long period as compared to the comparison test samples, i.e. it remained flowable at the end of the experiment (12 months after preparation of the composition).

In certain embodiments, the paste form of the surfactant composition requires relatively lower temperature to be melted, and subsequently be formulated into detergents. Therefore, the composition of the invention can be readily used as a surfactant system in various applications, especially in the formulation of liquid detergents.

While the invention has been disclosed in connection with the preferred embodiments shown and described in detail, various modifications and improvements thereon will become readily apparent to those skilled in the art. Accordingly, the scope of the invention is not to be limited by the following non-limiting examples, but is to be understood in the broadest sense allowable by law.

EXAMPLE

Example 1 SME Paste Surfactant Composition

The various formulations of the surfactant composition prepared in the form of paste are shown in Table 1 (Formulation 1) and Table 2 (Formulation 2).

TABLE 1

| Ingredient | Weight Percentage (% wt) |
|---|---|
| C16-C18 SME | 40-50 |
| C12-C14 SME | 10-20 |
| CMEA | 5-10 |
| IPA | 5-10 |
| Water | To 100% |

TABLE 2

| Ingredient | Weight Percentage (% wt) |
|---|---|
| C16-C18 SME | 35-75 |
| C12-C14 SME/SLES | 8.5-35 |
| CMEA | 5-10 |
| CDEA | 5-10 |
| IPA | 5-10 |
| Water | to 100% |

Example 2 Flowability Test of SME Paste Surfactant Composition

A flowability test was conducted on a sample of the surfactant composition (Sample C), which was prepared based on Formulation 1 as detailed in Table 1, in parallel with two comparison test samples (Samples A and B) prepared using the respective formulations as tabulated in Table 3. All samples were observed and their appearances were recorded on Day 0 of the experiment. These samples were then stored at 35° C., with their physical states were being regularly observed and recorded.

TABLE 3

| Ingredient | Sample A | Sample B | Sample C |
|---|---|---|---|
| C16-C18 SME (% wt) | 64 | 64 | 40-50 |
| C12-C14 SME (% wt) | — | — | 10-20 |
| SDS (% wt) | 4 | 4 | — |
| CPAB (% wt) | 3 | 3 | — |
| Sodium citrate (% wt) | 2 | — | — |
| IPA (% wt) | — | 2 | 5-10 |
| CMEA (% wt) | — | — | 5-10 |
| Water (% wt) | 27 | 27 | to 100 |
| Appearance | White spots | Solid block | Pasty flowable mass |
| Period which sample turn into solid | 10 days | 16 days | Remains flowable |

The comparison test sample A represents the type of SME-based surfactants which is available in the market or the existing technologies. These samples contain only SME of C16 and C18, and other ingredients including sodium dodecyl sulfate (SDS), fatty acid acyl betaine such as cocamidopropyl betaine (CPAB) and sodium citrate. As shown in Table 3, Sample A turned into solid mass at 35° C. in approximately 10 days.

Samples B is a test sample having formulation modified from that of A by replacing sodium citrate with IPA, which is the hydrotrope that assists in solubilising the surfactant composition. The results showed that the addition of IPA slightly prolonged the flowable state of Sample B from 10 days to 16 days, as compared to Sample A.

Lastly, it was demonstrated in Sample C, which contains the blend of two SME compounds containing respectively SME of C16-C18 and C12-C14, IPA and CMEA that the flowable state remains to the end of the experimental period (i.e. 12 months). The experimental results demonstrated that, the addition of hydrotrope and the non-ionic co-surfactant is also capable of enhancing the solubility of the surfactant composition, asides from the flowability property achieved by the specific blend of two SME compounds.

The flowability state of Sample C observed and recorded 12 months from the date of preparation is further shown in FIG. 1, in comparison to the non-flowable state of Sample A observed and recorded 10 days from the date of preparation. As shown in FIG. 1, there are non-flowable white solids generated from the paste that are stuck to the bottom and side walls of the bottom containing Sample A; while Sample C is shown to be in the form of paste and able to flow down when the sample bottle was reversely placed during the experiment.

Example 3 Detergency Test of SME Paste Surfactant Composition

A detergency test was conducted using a sample of SME paste surfactant composition (SME). As a comparison, samples of linear alkylbenzene sulphonate (LAS) and a combination between LAS and SME were also included in the test. JB-03 sebum pigment was used as the stain for the detergency test. The following washing parameters were applied:

a) Temperature: 30° C.

b) Dosage: 0.3 gram/L c) Water hardness: 100 ppm, 250 ppm and 500 ppm.

Figure 2:
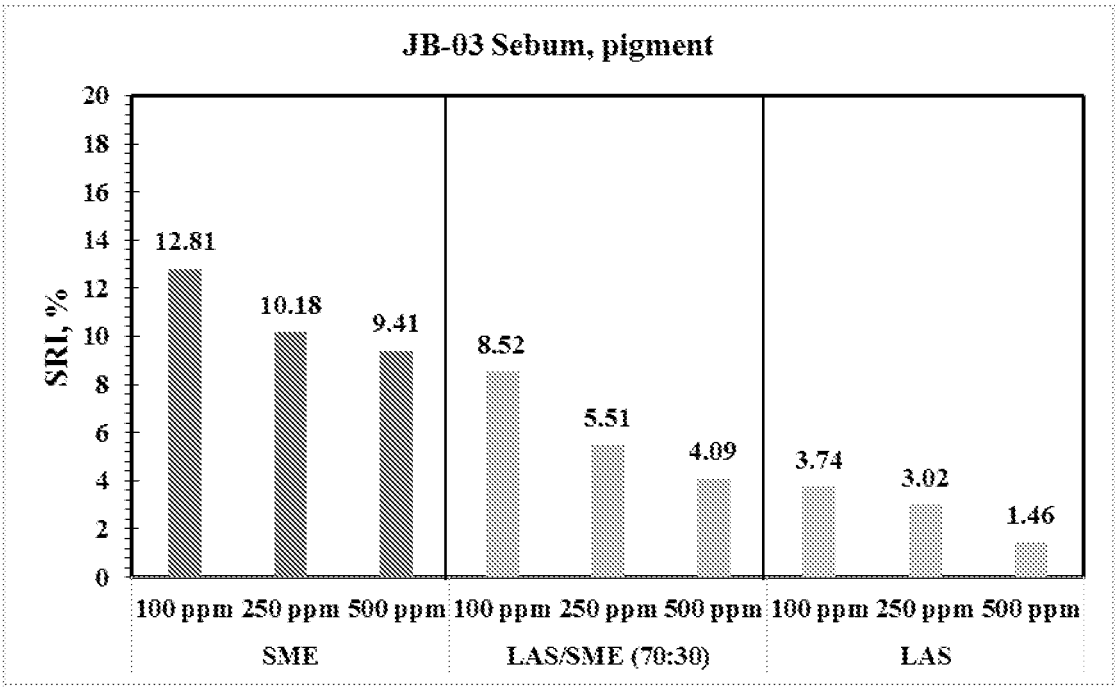
FIG. 2 is a graph showing soil removal index (SRI) of three samples, including SME-based surfactant composition (SME) as described in one of the embodiments of the invention, linear alkylbenzene sulphonate (LAS) and the combination thereof (SME/LAS), under different water hardness conditions.

The soil removal index (SRI) of the various samples was then obtained under different water hardness conditions, and the results were plotted onto a graph as shown in FIG. 2. The SME sample has been shown to have a relatively higher SRI as compared to LAS. It is also shown in FIG. 2 that, with the addition of SME to LAS, the SRI of the sample can be improved.

Example 4 Production Process of the Surfactant Composition

A quantity of CMEA flakes was accurately weighed to give an approximately 5-10% total active matter. A quantity of a first anionic surfactant, i.e. a SME blend containing C16-SME and C18-SME, was then accurately weighed to give an approximately 40-50% total active matter; which was followed by accurately weighing a second anionic surfactant, i.e. a SME blend containing C12-SME and C14-SME, to give an approximately 10-20% total active matter. 5-10% IPA was added into the surfactant mixture, and the mixture was topped up with deionised water to 100%. The mixture was stirred until all the solids therewithin were fully dissolved. The combination ratios between the respective ingredients could be adjusted thereafter depending on the desired product formulations.

The invention claimed is:

1. A surfactant liquid, semi-solid or paste composition comprising:

a primary surfactant, present in an amount of 35% to 75% by weight of the composition;

a secondary surfactant, present in an amount of 8.5% to 35% by weight of the composition;

a non-ionic co-surfactant;

a hydrotrope; and a solvent, wherein the primary surfactant is a sulfonated methyl ester compound containing 55% to 95% C16 sulfonated methyl ester and 5% to 45% of C18 sulfonated methyl ester by weight of the primary surfactant; and the secondary surfactant is a sulfonated methyl ester compound containing 55% to 95% C12 sulfonated methyl ester and 5% to 45% of C14 sulfonated methyl ester by weight of the secondary surfactant, wherein the composition has a viscosity of 11.5 to 10.0 Pa·s under shear rate 10 s−1 at a temperature range of 35° C. to 45° C.

2. The composition according to claim 1, wherein the non-ionic co-surfactant is present in an amount of 5% to 10% by weight of the composition.

3. The composition according to claim 1, wherein the non-ionic co-surfactant is cocamide monoethanolamide, cocamide diethanolamide, or a combination thereof.

4. The composition according to claim 1, wherein the hydrotrope is present in an amount of 5% to 10% by weight of the composition.

5. The composition according to claim 1, wherein the hydrotrope is a primary, secondary or tertiary alcohol having a linear or branched alkyl chain of 3 to 8 carbon atoms.

6. The composition according to claim 5, wherein the hydrotrope is isopropyl alcohol or ethanol.

7. The composition according to claim 1, wherein the solvent is present in an amount of 5% to 30% by weight of the composition.

8. The composition according to claim 1, wherein the solvent is water.

9. A method of preparing a surfactant liquid, semi-solid or paste composition for use as a surfactant system in a detergent, the method comprising combining a primary surfactant, in an amount of 35% to 75% by weight of the composition; a secondary surfactant, in an amount of 8.5% to 35% by weight of the composition; a non-ionic co-surfactant; a hydrotrope; and a solvent, to form the surfactant composition, wherein the primary surfactant is a sulfonated methyl ester compound containing 55% to 95% C16 sulfonated methyl ester and 5% to 45% of C18 sulfonated methyl ester by weight of the primary surfactant; and the secondary surfactant is a sulfonated methyl ester compound containing 55% to 95% C12 sulfonated methyl ester and 5% to 45% of C14 sulfonated methyl ester by weight of the secondary surfactant, wherein the composition has a viscosity of 11.5 to 10.0 Pa·s under shear rate 10 s−1 at a temperature range of 35° C. to 45° C.

10. The composition according to claim 1, wherein the primary surfactant is a sulfonated methyl ester compound containing 60% to 90% C16 sulfonated methyl ester and 10% to 40% of C18 sulfonated methyl ester by weight of the primary surfactant.

11. The composition according to claim 1, wherein the primary surfactant is a sulfonated methyl ester compound containing 65% to 85% C16 sulfonated methyl ester and 15% to 35% of C18 sulfonated methyl ester by weight of the primary surfactant.

12. The composition according to claim 1, wherein the primary surfactant is a sulfonated methyl ester compound containing 75% C16 sulfonated methyl ester and 25% of C18 sulfonated methyl ester by weight of the primary surfactant.

13. The composition according to claim 1, wherein the primary surfactant is a sulfonated methyl ester compound containing 95% C16 sulfonated methyl ester and 5% of C18 sulfonated methyl ester by weight of the primary surfactant.

14. The composition according to claim 1, wherein the secondary surfactant is a sulfonated methyl ester compound containing 55% to 95% C12 sulfonated methyl ester and 5% to 45% of C14 sulfonated methyl ester by weight of the secondary surfactant.

15. The composition according to claim 1, wherein the secondary surfactant is a sulfonated methyl ester compound containing 60% to 90% C12 sulfonated methyl ester and 10% to 40% of C14 sulfonated methyl ester by weight of the secondary surfactant.

16. The composition according to claim 1, wherein the secondary surfactant is a sulfonated methyl ester compound containing 65% to 85% C12 sulfonated methyl ester and 15% to 35% of C14 sulfonated methyl ester by weight of the secondary surfactant.

17. The composition according to claim 1, wherein the secondary surfactant is a sulfonated methyl ester compound containing 75% C12 sulfonated methyl ester and 25% of C14 sulfonated methyl ester by weight of the secondary surfactant.

18. The composition according to claim 1, wherein the secondary surfactant is a sulfonated methyl ester compound containing 95% C12 sulfonated methyl ester and 5% of C14 sulfonated methyl ester by weight of the secondary surfactant.

* * * * *